US009302368B2

(12) United States Patent
Mase

(10) Patent No.: US 9,302,368 B2
(45) Date of Patent: Apr. 5, 2016

(54) PLATE-END PROCESSING METHOD AND BLASTING DEVICE

(75) Inventor: Keiji Mase, Tokyo (JP)

(73) Assignee: FUJI MANUFACTURING CO., LTD., Tokyo (JP)

( * ) Notice: Subject to any disclaimer, the term of this patent is extended or adjusted under 35 U.S.C. 154(b) by 93 days.

(21) Appl. No.: 13/593,964

(22) Filed: Aug. 24, 2012

(65) Prior Publication Data

US 2013/0059500 A1 Mar. 7, 2013

(30) Foreign Application Priority Data

Sep. 1, 2011 (JP) ..... 2011-190771

(51) Int. Cl.
*B24C 1/04* (2006.01)
*B24C 5/04* (2006.01)
*B24C 1/08* (2006.01)

(52) U.S. Cl.
CPC .. *B24C 1/083* (2013.01); *B24C 5/04* (2013.01)

(58) Field of Classification Search
CPC ..... B24C 1/083; B24C 1/08; B24C 1/045; B24C 5/04
USPC ..... 451/38, 87, 102
See application file for complete search history.

(56) References Cited

U.S. PATENT DOCUMENTS 2,092,083 A * 9/1937 Ogle et al. ..... 451/82
2,628,456 A * 2/1953 Berg ..... 451/87
4,169,556 A * 10/1979 Muller ..... 239/434
4,237,209 A * 12/1980 Oliver ..... 430/317
4,435,902 A * 3/1984 Mercer et al. ..... 30/296.1
4,563,840 A * 1/1986 Urakami ..... 451/102
4,633,623 A * 1/1987 Spitz ..... 451/102
4,658,683 A * 4/1987 Phillips ..... 83/53
4,711,056 A * 12/1987 Herrington et al. ..... 451/40
4,827,679 A * 5/1989 Earle, III ..... 451/40
5,074,079 A * 12/1991 Park ..... 451/11
5,117,366 A * 5/1992 Stong ..... 700/160
5,265,383 A * 11/1993 Shank, Jr. ..... 451/90
5,283,990 A * 2/1994 Shank, Jr. ..... 451/90
5,928,719 A * 7/1999 Mishima et al. ..... 427/180

(Continued)

FOREIGN PATENT DOCUMENTS

AT 8700670 A * 5/1988
JP 01319991 A * 12/1989
JP 04261776 A * 9/1992
JP 04331074 A * 11/1992
JP 2003191167 A 7/2003
JP 2009064514 A * 3/2009

(Continued)

OTHER PUBLICATIONS

Japanese Office action dated Apr. 20, 2015, 3 pages.

*Primary Examiner* — Lee D Wilson
*Assistant Examiner* — Joel Crandall
(74) *Attorney, Agent, or Firm* — Cooper Legal Group, LLC

(57) ABSTRACT

A plate-end processing method comprises the steps of disposing a slit nozzle having a slit-shaped opening at a nozzle tip such that a longitudinal direction of the opening extends along a longitudinal direction of an edge formed along an end of a plate, and such that a distance between the tip of the nozzle and an apex of the edge is equal to 3 mm or smaller, and ejecting an abrasive with a median diameter smaller than or equal to 20 μm with an ejection pressure of 0.1 MPa to 0.5 MPa to the edge via the nozzle and collecting the ejected abrasive and the abrasive and cut dusts adhered to the plate by suctioning the ejected abrasive, the adhered abrasive and cut dusts from a front side of an ejecting direction of the abrasive at an average flow rate of 30 m/s or higher.

10 Claims, 13 Drawing Sheets

(56) References Cited

U.S. PATENT DOCUMENTS

| | | | | |
|---|---|---|---|---|
| 6,293,857 | B1 * | 9/2001 | Allard | 451/102 |
| 7,695,346 | B2 * | 4/2010 | Ishibashi et al. | 451/39 |
| 8,523,632 | B2 * | 9/2013 | Mase et al. | 451/38 |
| 2001/0007808 | A1 * | 7/2001 | Mishima et al. | 451/38 |
| 2008/0233838 | A1 * | 9/2008 | Mase et al. | 451/38 |
| 2010/0122719 | A1 * | 5/2010 | Mase et al. | 136/244 |
| 2011/0021116 | A1 | 1/2011 | Brown et al. | |
| 2012/0184185 | A1 | 7/2012 | Kanazawa et al. | |

FOREIGN PATENT DOCUMENTS

| | | | | |
|---|---|---|---|---|
| JP | 2010504859 | A | | 2/2010 |
| JP | 2011-26195 | | | 2/2011 |
| KR | 20030054720 | A | * | 7/2003 |
| WO | 2008044613 | A1 | | 9/2007 |
| WO | WO 2008044613 | A1 | * | 4/2008 |
| WO | 2011046142 | A1 | | 4/2011 |
| WO | WO 2011152073 | A1 | * | 12/2011 |

* cited by examiner

PLATE-END PROCESSING METHOD AND BLASTING DEVICE

BACKGROUND OF THE INVENTION

1. Field of the Invention

The present invention relates to plate-end processing methods and blasting devices used in such methods, and more particularly, to a plate-end processing method suitable for processing, e.g., slight-chamfering or deburring an edge formed at the end of a plate, specifically, a plate composed of a hard, brittle material such as a glass plate, and to a blasting device used for performing the method.

2. Description of the Prior Art

A plate obtained by cutting out a large plate, such as a metal plate, a glass plate or the like has a sharp edge at the end thereof. In the case of a metal plate or the like, burrs may be adhered to the end thereof. If a person directly touches such a sharp edge or burrs with his/her hand, he/she could possibly hurt his/her hand, or if an object comes into contact with such a sharp edge or burrs, the object could possibly become scratched. Therefore, the end is generally processed by, for example, deburring or chamfering for removing the sharpness from the edge.

In particular, with regard to a plate composed of a hard, brittle material, such as a glass plate, a quartz plate, a sapphire plate, a ceramic plate, or a silicon wafer, if the plate still has a sharp edge even after the side surface thereof is mirror-polished, the edge tends to chip easily. Therefore, when bending stress is applied to such a plate composed of a hard, brittle material, the entire plate may readily crack starting from the chipped section on the edge.

Therefore, edge processing, such as edge chamfering or slight-chamfering of such a plate composed of a hard, brittle material, is important for increasing the strength of the plate.

With regard to a glass plate used as the aforementioned plate, the glass plate may be used as a substrate for a flat display, such as a liquid crystal display or a plasma display. For such intended usage, the demand for thin glass plates is increasing. As a result, it is necessary to process the end, such as the edge, finely with high accuracy. For example, it is necessary to perform slight-chamfering at a 0.5-mm width or smaller accurately and precisely without errors.

In the related art, slight-chamfering is generally performed on a plate by inserting an end of a plate 100 into a groove 111 of a rotating grooved grindstone 110 so as to grind the end as shown in FIG. 9, or by bringing each edge 101 at the end of the plate 100 into contact with a flat surface 121 of a rotating grinding wheel 120 as shown in FIG. 10. With regard to this chamfering process performed by bringing the end into contact with the flat surface 121 of the rotating grinding wheel 120, Japanese Patent Laid-Open No. 2011-26195 proposes another example of a method in which two grinding wheels 120 and 120 tilted relative to flat surfaces 102 and 103 of the plate 100 are provided such that the edges 101 are chamfered by grinding the end of the plate 100 interposed between the grinding wheels 120 and 120 as shown in FIG. 11.

Sandblasting is a known type of a cutting process for processing a surface to be processed of a workpiece by ejecting abrasive grains thereto together with compressed gas. Such sandblasting is sometimes performed on, for example, an end of a plate so as to remove the sharp edges therefrom, thereby obtaining a rounded end.

If the chamfering process is to be performed by using the grooved grindstone 110 as shown in FIG. 9 from among the aforementioned grinding methods, since the grindstone 110 and the edges 101 of the plate 100 are in point-contact with each other, the grindstone 110 becomes abraded relatively quickly or becomes jammed at these contact areas.

If such an abraded or jammed grindstone 110 is continuously used, a significant variation will occur between products processed before and after the occurrence of the deformation or jamming. Thus, the method cannot be used for processing glass plates that are to be used in the field of flat displays, which need to be processed finely with high accuracy.

Therefore, with regard to a grindstone that is abraded or jammed at the areas in contact with the plate, the grindstone needs to be replaced even if other areas thereof are not abraded or jammed. Due to this reason, in order to increase the processing accuracy of the grinding process based on this method, the grindstone needs to be replaced frequently, leading to an increase in costs.

On the other hand, in the method in which the chamfering process is performed by pressing each edge 101 of the plate 100 onto the flat surface 121 of the rotating grinding wheel 120 as described above with reference to FIG. 10, local abrasion of the grinding wheel 120 can be prevented so that the lifespan thereof can be extended, as compared with a case where the grinding process is performed by using the grooved grindstone 110 described above with reference to FIG. 9.

However, this method is problematic in that the plate 100 may become warped due to a processing pressure applied to the plate 100 for pressing the edge 101 onto the flat surface 121 of the grinding wheel 120, and in that both edges 101 and 101 at the top and bottom sides of the plate 100 need to be processed individually. This results in lower workability as compared with the method shown in FIG. 9 in which both edges can be processed simultaneously.

In the method discussed in Japanese Patent Laid-Open No. 2011-26195, the edges 101 and 101 formed at the top and bottom sides of the plate 100 interposed between the two grinding wheels 120 and 120 are simultaneously removed so that the chamfering process can be performed efficiently. In addition, the processing pressures applied to the plate 100 are counterbalanced so that the plate 100 is prevented from warping, whereby the aforementioned problems in the grinding method described above with reference to FIG. 10 are solved.

However, in the method discussed in Japanese Patent Laid-Open No. 2011-26195, if processing pressures $F_1$ and $F_2$ applied by the two grinding wheels 120 and 120 are not properly balanced, the edges 101 and 101 cannot be processed uniformly, and the plate 100 may possibly become warped.

Although this can be generally said with regard to grinding a hard, brittle material by using a grindstone, when grinding a plate composed of a hard, brittle material such as a glass plate, various kinds of cracks such as large or small cracks or chipped section/s generally likely to occur (occurrence of such cracks or chipped sections will be collectively referred to as "chipping" hereinafter). In addition, cracks or small cracks called micro-cracks tend to form readily due to impacts caused during the cutting process. The occurrence of such chipping or cracks significantly reduces the bending strength of the plate starting from the fracture when bending stress is applied to the plate. On the other hand, it is difficult to remove the chipping and the cracks completely by the grinding process.

The occurrence of such chipping or cracks can be suppressed to some extent by supplying an abrasive liquid, such as water or oil, between the grindstone and the workpiece. However, when the abrasive liquid is supplied in this manner, a mixture of the abrasive liquid and cut dusts adhere to the surface of the workpiece so as to contaminate the workpiece.

Therefore, an additional step for cleaning the workpiece after the grinding process becomes necessary, resulting in an increased number of steps, which in turn results in an increase in workload, leading to an increase in cost required for processing and end of the plate.

As described above, sandblasting is sometimes used when giving the plate a rounded end by removing the edges therefrom.

However, in a generally known sandblasting process, the surface of the processed workpiece is satin-finished and thus cannot be planarized with high accuracy. In addition, cracks or micro-cracks are formed on the processed surface due to an impact generated when the abrasive grains collides therewith. Therefore, using the generally known sandblasting process for grinding a plate composed of a hard, brittle material such as a glass plate, leads to, for example, rather lower bending strength. Thus, sandblasting is not used for a chamfering process intended for increasing the strength of a plate composed of a hard, brittle material, or for a grinding process intended for removing cracks and micro-cracks.

In addition, in the generally known sandblasting process, it is difficult to make the abrasive ejected together with the compressed gas collide with a specific area. Therefore, if the sandblasting process is to be used for chamfering the aforementioned edges, not only are the chamfered sections processed, but also surrounding areas thereof extending several millimeters to several tens of millimeters therefrom are processed, making it impossible to perform the process with high accuracy.

Therefore, in the cutting process based on sandblasting, if a small specific area of the workpiece is to be cut, as in the slight-chamfering process, it is necessary to mask the areas that should not be processed so as to protect these areas. Consequently, a complicated process such as attaching a masking material to the workpiece and removing the masking material after the grinding process, is required.

Moreover, in the generally known sandblasting process, since the abrasive grains and the cut dusts adhere to the workpiece, a step for cleaning the workpiece after the cutting process is often required, resulting in an increased number of steps.

The present invention has been made to solve the problems in the related art described above. Specifically, an object of the present invention is to provide a plate-end processing method that can be widely applied to plates composed of various kinds of materials, can prevent the occurrence of chipping or cracks even if the workpiece is a plate composed of a hard, brittle material, allows for fine, highly-accurate processing (for example, slight-chamfering at a 0.5-mm width or smaller, preferably, extremely fine slight-chamfering at about 0.1-mm width) performed uniformly on a specific required area without having to perform a pretreatment, such as masking, allows for an economical process with small grindstone wear and abrasive grain consumption or the like, and prevents foreign particles from adhering to the workpiece so that a cleaning step after the process can be omitted.

SUMMARY OF THE INVENTION

Solutions for solving the aforementioned problems will be described below together with reference numerals used in an embodiment of the present invention. These reference numerals are provided for clarifying the correspondence relationship between the claims of the invention and the embodiment of the invention, but are not to be used for limiting the interpretation of the technical scope of the invention.

In order to achieve the above objective, a plate-end processing method according to the present invention is characterized by comprising:

disposing a slit nozzle 20 having a slit-shaped opening 21 at a nozzle tip 22 such that a longitudinal direction of the slit-shaped opening 21 extends along a longitudinal direction of an edge 11 to be processed, formed along an end of a plate 10, and such that a distance D (see FIG. 2A) between the tip of the slit nozzle 20 and an apex of the edge 11 is smaller than or equal to 3 mm, and ejecting an abrasive with a median diameter smaller than or equal to 20 μm with an ejection pressure of 0.1 MPa to 0.5 MPa to the edge 11 via the slit nozzle 20; and collecting the ejected abrasive and the abrasive and cut dusts adhered to the plate 10 by suctioning the ejected abrasive, the adhered abrasive, and the adhered cut dusts from a front side in an ejecting direction of the abrasive at an average flow rate of 30 m/s or higher.

In the plate-end processing method having the above-described configuration, the ejecting direction of the abrasive may be inclined relative to a flat surface of the plate 10 at an inclination angle θ (see FIGS. 2A and 3A) ranging between 45° and 85°.

Preferably, the nozzle tip 22 of the slit nozzle 20 is composed of diamond, corundum (ruby or sapphire), boron carbide, cubic boron nitride, silicon carbide, cemented carbide, or zirconia.

The opening of the slit nozzle 20 has a width W ranging between 0.1 mm and 3 mm, preferably ranging between 0.2 mm and 1.0 mm.

The abrasive may be ejected simultaneously to edges 11, 11 formed along opposite widthwise ends of a side surface at the end of the plate 10 (see FIG. 4).

Furthermore, an abrasive having a median diameter smaller than or equal to 20 μm or a grit number higher than or equal to #600 grit may be ejected with an ejection pressure of 0.1 MPa to 0.5 MPa to the side surface at the end of the plate 10 (see FIG. 5).

A blasting device 1 for processing and end of a plate according to the present invention as described above is characterized by comprising:

abrasive ejecting means 3 including a slit nozzle 20 having a slit-shaped opening 21 at a nozzle tip 22 and ejecting an abrasive with a median diameter smaller than or equal to 20 μm together with compressed gas with an ejection pressure of 0.1 MPa to 0.5 MPa via the slit nozzle 20;

a work base 4 on which the plate 10 serving as a workpiece is disposed at a front side in an ejecting direction of the abrasive from the slit nozzle 20 such that a longitudinal direction of the slit-shaped opening 21 extends along a longitudinal direction of an edge 11 to be processed, formed along an end of the plate 10, and such that a distance between the tip of the slit nozzle 20 and an apex of the edge 11 is smaller than or equal to 3 mm; and suction means 5 including an inlet 51*a* opened toward a front side of the ejecting direction of the abrasive and collecting the abrasive ejected from the slit nozzle 20 and the abrasive and cut dusts adhered to the workpiece by suctioning the ejected abrasive, the adhered abrasive, and the adhered cut dusts from the front side in the ejecting direction of the abrasive at an average flow rate of 30 m/s or higher.

In the blasting device 1 having the above described configuration, in case that the slit nozzle 20 can be moved in the longitudinal direction of the edge 11 formed along the end of the plate 10, preferably a link mechanism (not shown) that moves the inlet of the suction means toward the front side in the ejecting direction of the abrasive as the slit nozzle 20 moves.

Preferably, the nozzle tip 22 of the slit nozzle 20 is composed of diamond, corundum (ruby or sapphire), boron carbide, cubic boron nitride, silicon carbide, cemented carbide, or zirconia.

Furthermore, it is preferable that the opening of the slit nozzle 20 has a width ranging between 0.1 mm and 3 mm.

Moreover, the blasting device 1 having the above-described configurations may include a plurality of the slit nozzles 20 (two slit nozzles 20, 20 in the example shown in FIG. 4) that eject the abrasive simultaneously to edges 11, 11 formed along opposite widthwise ends of a side surface at the end of the plate 10, and in such configuration, another blast nozzle (see FIG. 5) that ejects an abrasive having a median diameter smaller than or equal to 20 μm or a grit number higher than or equal to #600 grit with an ejection pressure of 0.1 MPa to 0.5 MPa to the side surface 12 at the end of the plate 10 may be included.

With the configuration according to the present invention described above, the plate-end processing method and the blasting device according to the present invention can achieve the following notable advantages.

The nozzle used is the slit nozzle 20, the abrasive is ejected while disposing the slit nozzle 20 sufficiently close to the workpiece, fine abrasive with a relatively small grain size is ejected with a predetermined ejection pressure, and the ejected abrasive is suctioned at a predetermined flow rate from the front side in the ejecting direction of the abrasive during the abrasive ejecting process. Thus, slight-chamfering can be performed with high accuracy and high efficiency on a specific required area without having to perform masking or the like. For example, slight-chamfering for giving a surface 15 to be formed by chamfering a width $W_p$ (see enlarged view in FIG. 2A) of 0.5 mm or smaller, or extremely fine slight-chamfering for giving the surface 15 to be formed by chamfering a minimal width of 0.1 mm can be performed with high accuracy and high efficiency. In addition, even if the plate 10 to be processed is composed of a hard, brittle material such as a glass plate, the occurrence of chipping or cracks is prevented, and cracks and the like formed in a pretreatment such as scribing can be removed, thereby processing of an end of the plate to increase the bending strength thereof can be performed.

Furthermore, since the end of the plate is processed based on a dry processing method in which the abrasive is ejected together with compressed gas, as described above, an abrasive liquid such as water or oil, or an abrasive and cut dusts mixed in the liquid are prevented from adhering to the workpiece. In addition, since the ejected abrasive and the abrasive and cut dusts adhered to the workpiece are suctioned and collected at a relatively high flow rate, the abrasive and the cut dusts are prevented from adhering to the plate 10, thus eliminating the need for a step for cleaning the end-processed plate 10.

If the slit nozzle 20 is to be moved in the longitudinal direction of the edge 11 formed on the plate 10, such as when processing a long plate 10, the inlet 51*a* of the suction means 5 that performs the suctioning is moved simultaneously in conjunction with the movement of the slit nozzle by using a link mechanism (not shown), whereby the aforementioned positional relationship can be readily maintained.

The ejecting direction of the abrasive is inclined relative to a flat surface 13 (or 14) of the plate 10 at an inclination angle θ ranging between 45° and 85°, so that the inclination angle of the surface 15 to be formed by chamfering relative to the flat surface 13 (or 14) can be controlled in accordance with the selection of the inclination angle θ.

If the inclination angle θ is smaller than 45°, the edge 11 can be removed but the surface 15 to be formed by chamfering does not become a completely flat surface, resulting in a curved cross-sectional shape (see FIG. 7).

With the nozzle tip 22 of the slit nozzle 20 composed of a durable ultra-hard material, such as diamond, corundum (ruby or sapphire), boron carbide, cubic boron nitride, silicon carbide, cemented carbide, or zirconia, abrasion of the nozzle tip 22 can be suppressed even if the abrasive used has high hardness. As a result, the ejection opening of the nozzle can be maintained at fixed dimensions over a long period of time, thereby further reducing a variation in processing accuracy from product to product.

In the configuration in which the opening of the slit nozzle 20 has a width ranging between 0.2 mm and 1.0 mm, it is possible to perform the process with higher accuracy.

In the configuration (see FIG. 4) in which the abrasive is simultaneously ejected to the edges 11 and 11 formed along the opposite widthwise ends of the side surface 12 at the end of the plate 10, the two edges 11 and 11 can be simultaneously processed, thereby allowing for improved workability.

Furthermore, in addition to the ejection of the abrasive to the edges 11 and 11, an abrasive with about the same grain size is ejected with about the same ejection pressure to the side surface 12 at the end of the plate 10 (see FIG. 5), thereby improving the roughness of the side surface 12, as well as removing cracks or micro-cracks formed in this area due to a pretreatment such as scribing, simultaneously with the slight-chamfering process.

BRIEF DESCRIPTION OF THE DRAWINGS

The objects and advantages of the invention will become understood from the following detailed description of preferred embodiments thereof in connection with the accompanying drawings in which like numerals designate like elements, and in which.

DETAILED DESCRIPTION OF THE PREFERRED EMBODIMENT

Figure 1:
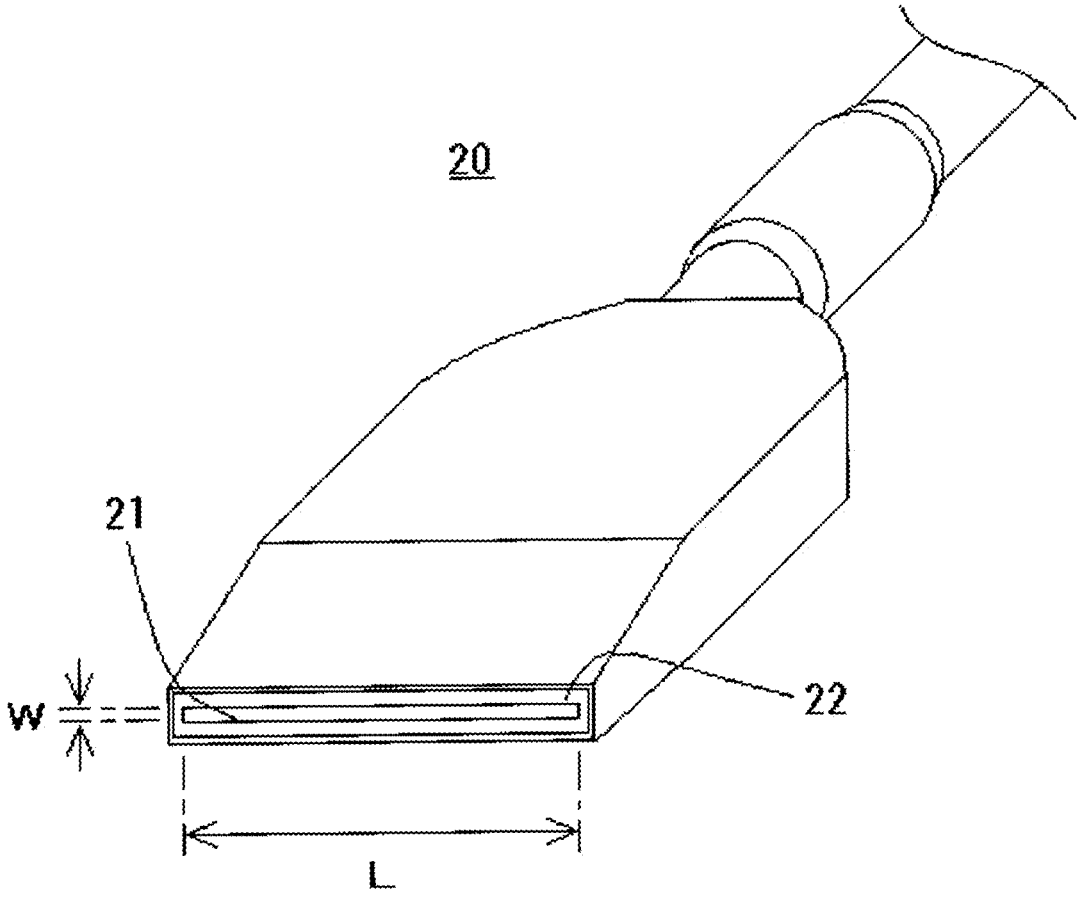
FIG. 1 is a perspective view illustrating an example of a slit nozzle used in the present invention.

An embodiment of the present invention will be described below with reference to the appended drawings.

Workpiece

A workpiece to be processed by a method according to the present invention may be composed of various kinds of materials so long as the material is in the form of a plate, and may be a metal plate, a ceramic plate, a glass plate, a quartz plate, a sapphire plate, or a synthetic resin plate, such as an acrylic plate, or may have a multilayer structure constituted by these materials.

A plate-end processing method according to the present invention is suitable for grinding a plate composed of a hard, brittle material without causing chipping or cracks therein and for removing cracks or the like formed in slight-chamfering or a pretreatment (such as scribing). Examples of the plate composed of a hard, brittle material, that is, a plate composed of a material that readily causes chips or cracks during a grinding process using a grindstone, include a ceramic plate, a glass plate, a quartz plate, a sapphire plate, a silicon wafer, and a cemented carbide plate such as a tungsten carbide plate.

The planar shape of the plate is not limited in particular. For example, a plate 10 to be processed by the method according to the present invention may be disk-shaped such that the outline thereof in plan view has a curved line only, or may be fan-shaped such that the outline partially includes a curved line.

However, it is preferable that the ends of the plate 10 to be processed have straight lines. Specifically, it is preferable that the plate 10 have a shape, such as a rectangular shape, so that the processing accuracy can be readily kept constant and that a relatively wide area thereof can be processed simultaneously.

However, even if the plate 10 has a curved outline, chamfering can be readily performed thereon by making a robot hold a nozzle and a suction pipe to be described later.

Abrasive

The material of an abrasive to be used in the grinding process can be selected from among various kinds of materials in accordance with the material of the plate to be processed. For example, if a glass plate is to be processed, an alundum abrasive, a carborundum abrasive, or other ceramic-based abrasives, in addition to cerium oxide powder and diamond powder generally used for grinding glass, may be used.

With regard to the grain size of the abrasive to be used, since a larger grain size means a larger cutting amount, it becomes difficult to perform fine processing. In addition, if the workpiece is a plate composed of a hard, brittle material such as a glass plate, an abrasive with a large grain size could damage the plate 10, such as causing the formation of cracks or micro-cracks in the plate 10, thus reducing the bending strength of the plate as a result of processing the end rather than increasing the bending strength thereof. Therefore, fine abrasive with a grit number higher than or equal to (i.e., a grain size smaller than or equal to) #600 grit is used. More preferably, fine abrasive with a grit number higher than or equal to (i.e., a grain size smaller than or equal to) #1000 grit is used.

Ejection Device (Blasting Device)

Because the aforementioned abrasive can be ejected by using various known kinds of air-type blasting devices that eject an abrasive together with compressed gas, e.g., compressed air, a description of the basic structure thereof will be omitted.

However, in a generally known blasting device, a so-called circular nozzle having a nozzle tip with a circular opening is generally used. In contrast, the blasting device used in the method according to the present invention is equipped with a slit nozzle having a slit-shaped opening at the tip thereof, as the ejection nozzle.

Furthermore, the blasting device used in the method according to the present invention is also different from a generally known blasting device in having suction means for suctioning the abrasive ejected from the aforementioned slit nozzle and cut dusts produced during the grinding process at a high flow rate.

1. Slit Nozzle

In the generally known blasting device, the abrasive is ejected by using the circular nozzle having the circular opening at the nozzle tip. In contrast, for example, as shown in FIG. 1, in the processing method according to the present invention, the abrasive is ejected by using a slit nozzle 20 having a slit-shaped opening 21 at a nozzle tip 22 in place of the circular nozzle.

With regard to the width W of the slit-shaped opening 21 provided in the slit nozzle 20, if the width is too large, the processing area increases, making it difficult to perform the process with high accuracy. On the other hand, if the width is too small, the rate of compressed gas flowing through the opening 21 increases, causing the inner surfaces of the opening 21 to be abraded significantly. Furthermore, if the slit-shaped opening 21 has a large width, a layer of ejected abrasive grains becomes thicker, leading to a large amount of unnecessary, wasted ejected grains that are not used for the process. On the other hand, if the slit-shaped opening 21 has too narrow width, the flow resistance against a fluid mixture constituted of the abrasive and the compressed gas increases, thus requiring an excessively high-performance compressed-gas supply source such as a compressor. Therefore, the width W of the slit-shaped opening 21 in the slit nozzle 20 preferably ranges between 0.1 mm and 3 mm, and more preferably ranges between 0.2 mm and 1 mm.

The length L of the slit-shaped opening 21 can be set in accordance with the length of one side of the plate 10 which is the workpiece and the shape thereof. However, if the length L is too small, the area that can be simultaneously processed is reduced, leading to lower processing efficiency. On the other hand, if the length L of the slit-shaped opening 21 is too large, it is not easy to make the rate of the abrasive flowing from the slit uniform in the longitudinal direction of the slit, leading to processing variations. Furthermore, because the weight of the nozzle increases with increasing slit length, a rigid structure is required in order to maintain the processing accuracy.

For example, the length of the slit-shaped opening 21 preferably ranges between 2 mm and 50 mm, and more preferably ranges between about 3 mm and 20 mm.

The nozzle tip 22 of the slit nozzle 20 may be composed of a ceramic material such as alumina; cemented carbide such as tungsten carbide; or hardened steel used as a material for the nozzle tip of the ejection nozzle in the known blasting device.

However, if the plate which is the workpiece is composed of a hard material so that the abrasive used also has high hardness, the nozzle tip 22 of the slit nozzle 20 is preferably composed of a material with higher durability than that of the material used for the general nozzle tip mentioned above so that abrasion of the nozzle tip 22 caused by the passed abrasive during the ejection of the abrasive is suppressed, thereby preventing the slit-shaped opening from enlarging and also preventing a change in the processing conditions over time.

Examples of such durable materials used for the nozzle tip include ultra-hard materials, such as diamond, corundum (ruby or sapphire), boron carbide, cubic boron nitride, silicon carbide, cemented carbide, or zirconia. Among these materials, diamond is preferred.

For example, if the nozzle tip used is composed of diamond, the amount of abrasion at one side of the slit-shaped opening can be suppressed to 20 μm even after a #1000 grit WA abrasive is ejected with an ejection pressure of 0.3 MPa for 60 hours. For example, as compared with a nozzle tip made of boron carbide, the lifespan can be made ten times longer.

2. Suction Means

The abrasive ejected from the slit nozzle 20 having the above-described configuration is suctioned and collected at an average flow rate of 30 m/s or higher by suction means 5 having an inlet 51*a* disposed at a front side of the ejecting direction of the abrasive.

Figure 6:
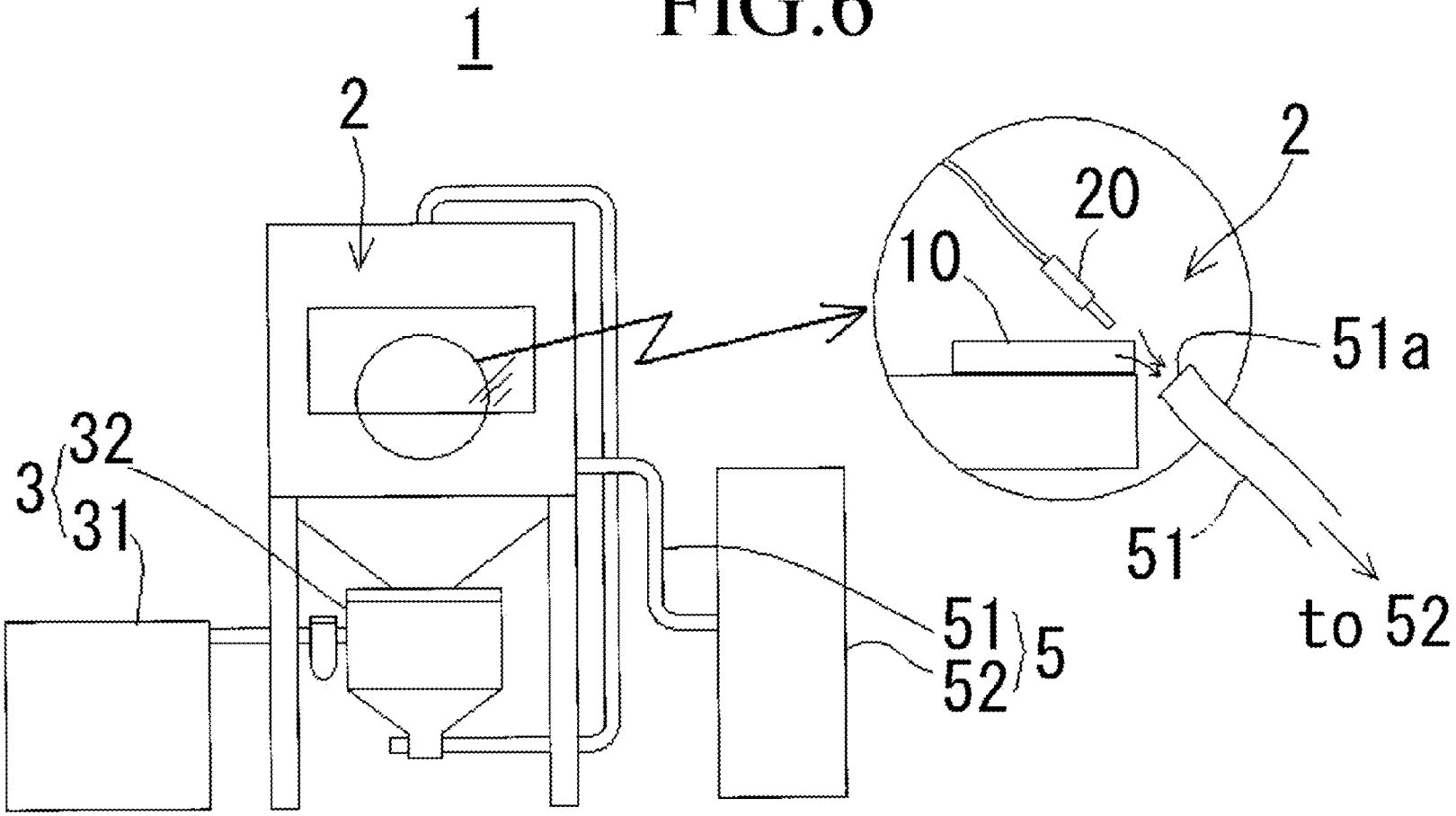
FIG. 6 schematically illustrates a blasting device according to the present invention.

As illustrated in FIG. 6, in this embodiment, the aforementioned inlet 51*a* is defined by orientating an opening at one end of an intake hose 51 disposed within a processing chamber 2 of a blasting device 1 toward the opening 21 of the slit nozzle 20. Furthermore, the other end of the intake hose 51 is connected to a blower 52 provided outside the processing chamber 2 so that a suction force with the average flow rate of 30 m/s or higher is generated through the inlet 51*a*.

Although the aforementioned intake hose is provided within the processing chamber 2 in the example shown in the drawing, a duct or another configuration may be used in place of the intake hose so long as the ejected abrasive can be suctioned.

The cross-sectional shape of the intake hose 51 or the intake duct provided in the suction means is not limited in particular and may be, for example, circular or polygonal so long as the aforementioned suction force can be exhibited. However, in order to reliably collect the abrasive ejected from the slit nozzle 20 without causing it to scatter throughout the processing chamber 2, the inlet 51*a* is given a diameter larger than the length L of the slit-shaped opening 21 provided in the slit nozzle 20, preferably, a diameter that is 1.5 to 2.5 times the length L of the slit-shaped opening 21, so that the abrasive can be reliably suctioned and collected without scattering to the surrounding area.

If the diameter of the inlet 51*a* provided in the suction means 5 exceeds 2.5 times the length of the slit-shaped opening 21, a large blower is required for performing the suctioning at an average flow rate of 30 m/s or higher, which is not economical.

If the inlet 51*a* is disposed too far from the slit nozzle or the workpiece, there is a possibility that the abrasive ejected from the slit nozzle 20 cannot be entirely collected. Therefore, the distance from the tip of the slit nozzle 20 to the inlet 51*a* is preferably set between 10 mm and 50 mm.

In the suction means 5, the inlet needs to be set at a proper position located on an extension of the slit nozzle 20 in the ejecting direction. Therefore, when performing the process while moving the slit nozzle 20 such as when processing a long workpiece, for example, the slit nozzle 20 and the aforementioned intake hose 51 are connected to each other by a link mechanism (not shown) so that the inlet 51*a* of the intake hose 51 is moved relative to the movement of the slit nozzle 20, whereby the inlet 51*a* is always disposed at a front side in the direction in which the abrasive is ejected from the slit nozzle 20.

3. Other Configurations (Abrasive Ejecting Means, Etc.)

Reference numeral 32 in FIG. 6 denotes an abrasive pressurizing tank. The abrasive pressurizing tank 32 in which the abrasive is fed is pressurized by introducing compressed gas therein from a compressed-gas supply source 31 such as a compressor. Moreover, a fluid mixture constituted of the compressed gas and the abrasive is supplied to the aforementioned slit nozzle 20 from the abrasive pressurizing tank 32 so as to eject the abrasive.

Therefore, in the configuration of the blasting device 1 shown in FIG. 6, the abrasive pressurizing tank 32, the compressed-gas supply source 31, and tubes such as rubber hoses that guide the abrasive and the compressed air within the abrasive pressurizing tank 32 to the slit nozzle 20, constitute abrasive ejecting means 3.

Although the abrasive ejecting means 3 is of a so-called direct pressure type equipped with the abrasive pressurizing tank 32 in the example shown in FIG. 6, abrasive ejecting means of a so-called suction type that suctions the abrasive from an abrasive tank by negative pressure generated at an ejector provided in a flow passage of the compressed gas and causes the abrasive to merge with the compressed gas so as to eject the abrasive may be used as an alternative.

Furthermore, the blasting device 1 is provided with a work base 4, a jig (not shown) for fixing the plate 10 on the work base 4 and the like between the slit nozzle 20 and the inlet 51*a* of the suction means 5 so that an edge 11 of the plate 10 which is the workpiece can be disposed at a predetermined position.

In addition to the suctioning through the aforementioned inlet 51*a*, the blasting device 1 may use the blower 52 constituting the suction means 5 or an additional blower different from the blower 52 to suction the entire processing chamber 2 at a flow rate of about 15 m/s so as to collect the abrasive, cut dusts and the like that could not be collected through the inlet 51*a*.

Processing Method

Figure 2A:
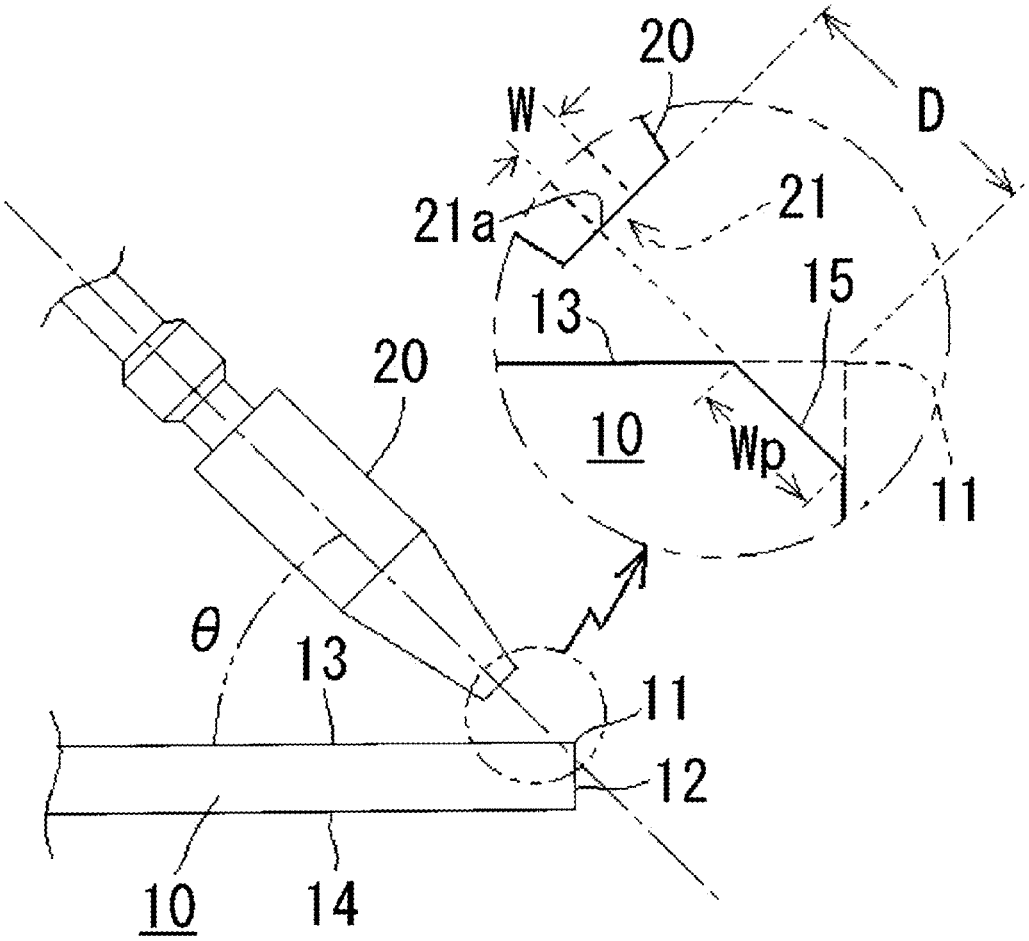
FIGS. 2A and 2B are a side view and a plan view respectively illustrating the positional relationship between a plate (i.e., a plate having a straight end) and the slit nozzle in a method according to the present invention.
Figure 2B:
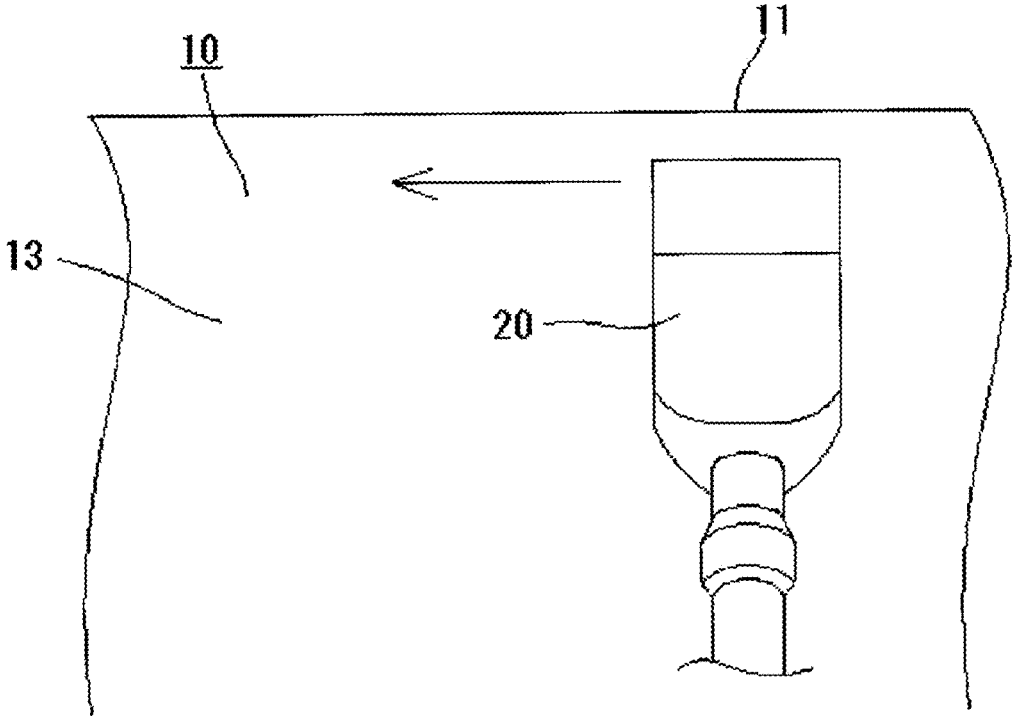
Figure 3A:
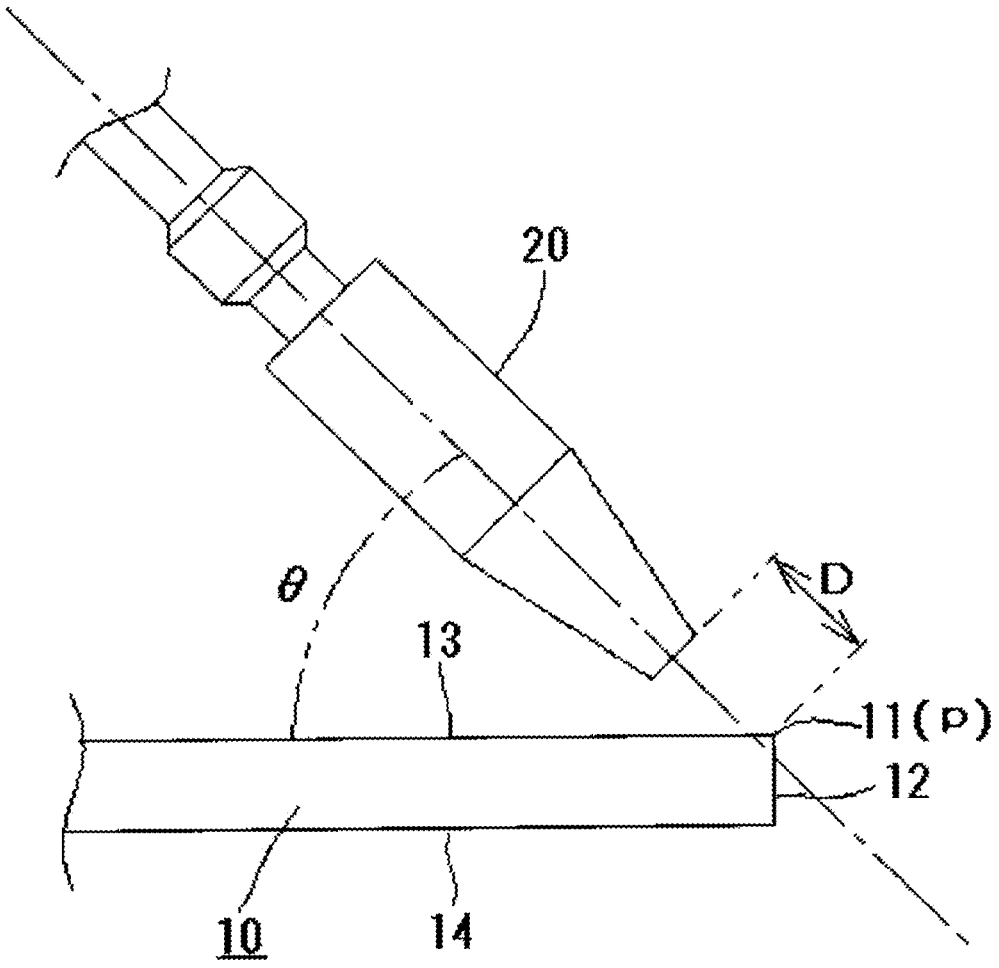
FIGS. 3A and 3B are a side view and a plan view respectively illustrating the positional relationship between a plate (i.e., a plate having a curved end) and the slit nozzle in a method according to the present invention.
Figure 3B:
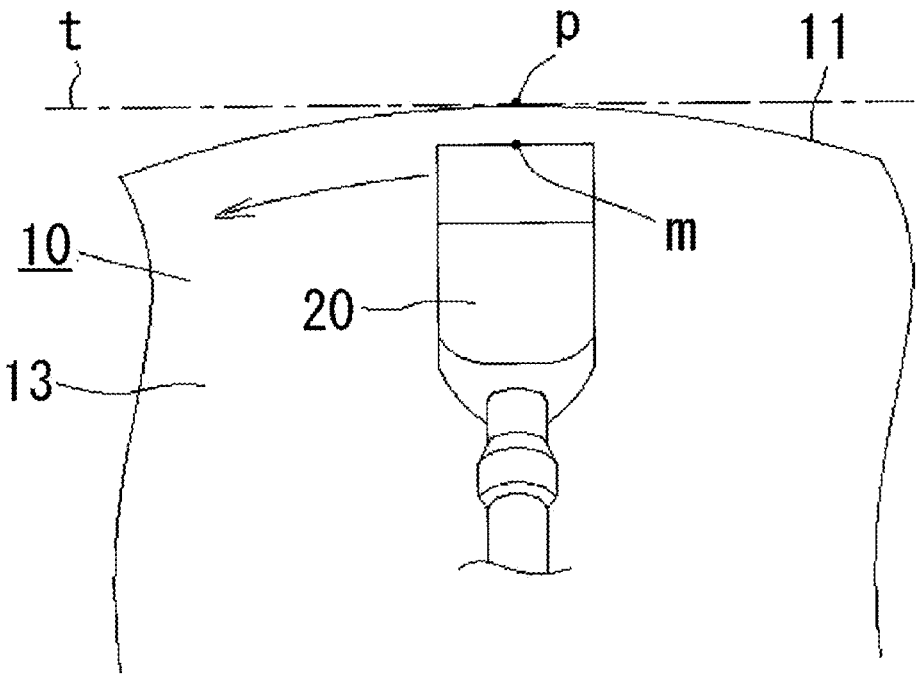

As shown in FIGS. 2B and 3B, the abrasive is ejected to the plate 10 which is the workpiece in a state where the lengthwise direction (i.e., the widthwise direction of the slit nozzle 20) of the slit-shaped opening 21 in the slit nozzle 20 is aligned with the longitudinal direction of the edge 11 formed at the end of the plate 10, and a distance D between the tip of the slit nozzle 20 and the edge 11 is smaller than or equal to 3 mm.

In a general blasting process, the distance (ejection distance) between the nozzle and the workpiece is normally set between about 50 mm and 200 mm. In contrast, in the method according to the present invention, the abrasive is ejected in a state where the nozzle and the workpiece are positioned extremely close to each other at 3 mm or smaller. Thus, slight-chamfering can be performed with high accuracy without having to perform masking or the like.

In the case where the end of the plate 10 which is the workpiece is formed in a straight line as shown in FIG. 2B, the direction of the length L of the slit-shaped opening 21 and the lengthwise direction of the edge 11 are set parallel to each other. In the case where the end of the plate 10 is formed in a curved line as shown in FIG. 3B, assuming that a tangent with respect to this curved line is defined as t, for example, the slit nozzle 20 is disposed such that the slit nozzle 20 is parallel to this tangent t and that a contact point p is set at a position corresponding to an intermediate position m in the direction of the length L of the slit-shaped opening 21.

In the case where the end of the plate 10 is formed in a curved line in this manner, the distance between the tip of the slit nozzle 20 and an apex of the edge, which is smaller than or equal to 3 mm, is set as the distance between the intermediate position m in the direction of the length L of the slit-shaped opening 21 and the contact point p.

An inclination angle θ is set such that the abrasive is projected at an angle that corresponds to an angle formed between a plate surface 13 and a surface 15 to be formed by chamfering.

Figure 7:
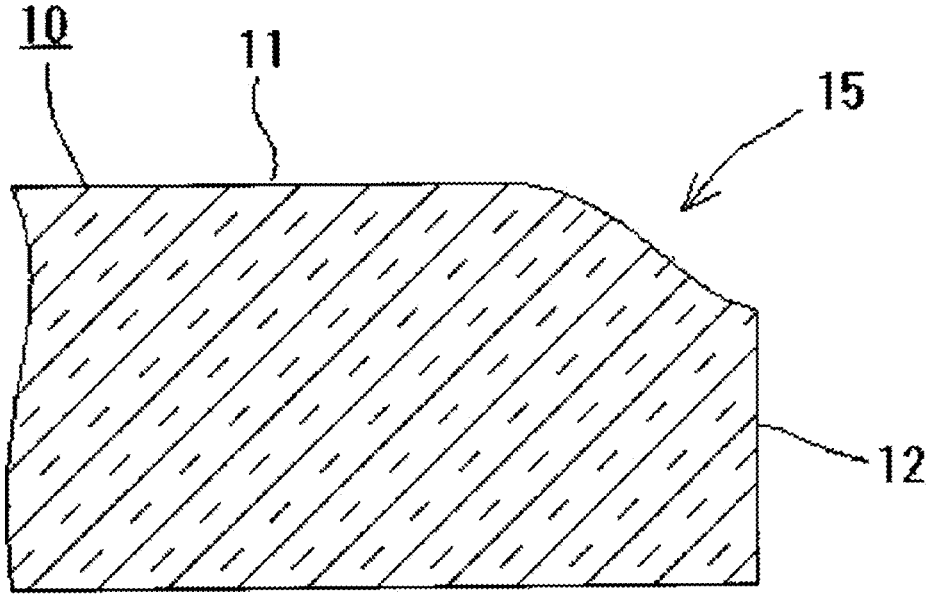
FIG. 7 is a schematic cross-sectional view of an end of a glass plate (Example 1: ejection angle of 30°) processed based on the method according to the present invention.

Accordingly, the inclination angle θ is set depending on what inclination angle the surface 15 is to have after the chamfering process. Although the inclination angle θ is selected in accordance with an ultimate processed state of the plate 10, the inclination angle θ ranges between, for example, 45° and 85°. If the ejection is performed at an acute angle smaller than 45°, the surface 15 to be formed by chamfering would have a curved cross-sectional shape instead of a completely flat shape, as shown in FIG. 7. Therefore, in order to form a flat surface with higher accuracy, the abrasive is preferably ejected at an ejection angle of 45° or larger.

Furthermore, the slit nozzle 20 is positionally adjusted in the left-right direction in FIG. 2A in accordance with the width $W_p$ of the surface 15 to be formed by chamfering, such that when the slit nozzle 20 moves rightward in FIG. 2A, the width $W_p$ of the surface 15 to be formed by chamfering decreases, whereas when the slit nozzle 20 moves leftward in FIG. 2A, the width $W_p$ of the surface 15 increases. For example, as shown in an enlarged view in FIG. 2A, the slit nozzle 20 is positionally adjusted such that one widthwise end 21*a* (i.e., an end closer to the plate 10) of the opening 21 is positioned on an extension of the surface 15 to be formed by chamfering.

Therefore, if the slit-shaped opening 21 in the slit nozzle 20 enlarges due to abrasion as mentioned above, the slit nozzle 20 can be positionally adjusted so that one widthwise end 21*a* of the enlarged slit-shaped opening 21 is positioned on the extension of the surface 15 to be formed by chamfering. In order to achieve this, the relationship between the processing time and the amount of abrasion of the nozzle tip 22 may be obtained in advance so that the position of the slit nozzle 20 may be, for example, automatically corrected in correspondence with the processing time, thereby compensating for a change in the processing conditions (ejection position) caused by the abrasion of the nozzle tip 22.

After positionally adjusting the slit nozzle 20 relative to the plate 10 which is the workpiece, in the above-described manner, the abrasive is ejected together with compressed gas, i.e., compressed air in this embodiment, with an ejection pressure of 0.1 MPa to 0.3 MPa from the aforementioned slit nozzle 20, and the aforementioned suction means suctions and collects the ejected abrasive and cut dusts produced as the result of the abrasive colliding with the end of the plate 10, at a flow rate of 30 m/s or higher.

If the plate 10 to be processed has a relatively small size with short sides, the length L of the opening 21 in the slit nozzle 20 may be made larger than or equal to the length of each side of the plate 10, and the process may be performed in a state where the slit nozzle 20 and the plate 10 are fixed in position. If the end of the plate 10 is longer than the length L of the opening 21 in the slit nozzle 20, the slit nozzle 20 may be relatively moved in the longitudinal direction of the edge 11 as indicated by an arrow in each of FIGS. 2B and 3B, while maintaining the positional relationship between the aforementioned slit nozzle 20 and the plate 10, so as to perform slight-chamfering over the entire length of the end.

The abrasive ejected from the slit nozzle 20 accurately grinds the edge 11 at the end of the plate 10 so that an extremely-fine slight-chamfering process for forming the surface 15 to be formed by chamfering to a width $W_p$ of 0.5 mm or smaller, or about 0.1 mm at minimum, can be performed with high accuracy.

In addition, in a normal blasting process, if the process is performed without performing masking, a clear boundary between the processed area and the non-processed area is not formed and the boundary is unclear. In contrast, when the plate 10 having undergone slight-chamfering based on the method according to the present invention is observed, a clear boundary line can be seen between the surface 15 to be formed by chamfering and the original flat surface 13 of the plate 10. In addition, there is no sign of grinding performed on the remaining non-chamfered flat areas.

When the process is performed on a glass plate, there is no chipping or cracks formed in the plate 10 even when the abrasive with the aforementioned grain size is ejected thereto with the aforementioned ejection pressure. Moreover, since the force applied to the processed area of the plate 10 during this process is about 0.3 N, there is no need to be concerned about the plate warping due to this process.

Furthermore, since the ejected abrasive and the cut dusts produced by the grinding process are suctioned and collected at high speed at an average flow rate of 30 m/s or higher by the suction means, the abrasive and the cut dusts are prevented from adhering to the processed plate 10.

Accordingly, with the method according to the present invention, highly-accurate slight-chamfering can be performed with high efficiency without having to perform masking or the like and also without the occurrence of chipping and cracks. In addition, the abrasive and the cut dusts are prevented from adhering to the processed plate so that a cleaning step after the process can be omitted.

Modifications

Figure 4:
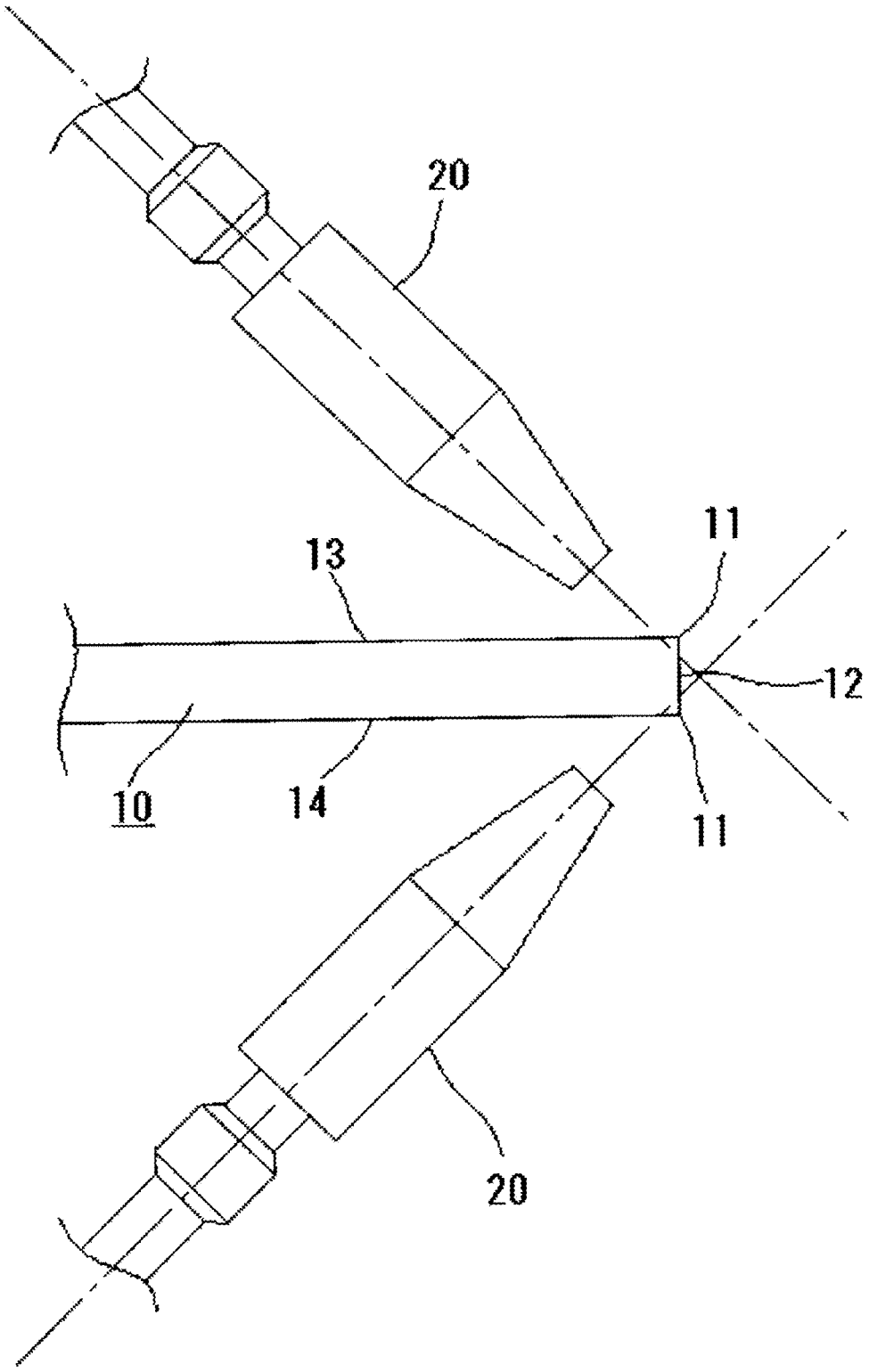
FIG. 4 illustrates a processing example in which slight-chamfering is simultaneously performed on two edges at the end of the plate by ejecting an abrasive thereto from two directions by using the method according to the present invention.

Although the embodiment described above with reference to FIGS. 2A to 3B is directed to slight-chamfering the edge 11 formed at one side of the plate 10, the slight-chamfering process may be simultaneously performed on edges 11 and 11 formed along both widthwise ends of a side surface 12 of the plate 10 by ejecting the abrasive thereto from two directions by using the plate-end processing method according to the present invention, as shown in FIG. 4.

By performing the process simultaneously on the two edges 11 and 11 from two directions in this manner, the processing time can be significantly shortened, and the plate 10 can be reliably prevented from warping since the processed areas of the plate 10 receive equal forces at both surfaces 13 and 14 when the abrasive is being ejected.

Furthermore, in addition to the configuration shown in FIG. 4, an additional abrasive with a grit number higher than or equal to #600 grit may be ejected with an ejection pressure of 0.1 MPa to 0.3 MPa to the side surface 12 of the plate 10 so that the abrasive is simultaneously ejected from three directions, thereby simultaneously performing the slight-chamfering process on the edges 11 and 11 and the grinding process on the side surface 12 of the plate 10.

In this case, with regard to the ejection of the abrasive to the side surface 12, the same kind of slit nozzle used for ejecting the abrasive to the edges 11 and 11 may be used, and the abrasive may be ejected from the same ejection distance. Alternatively, the abrasive may be ejected to the side surface 12 by using a known circular nozzle so long as the abrasive has the aforementioned grain size and is ejected with the aforementioned ejection pressure that can prevent damage such as cracks and micro-cracks to the plate 10. Moreover, the abrasive may be ejected from a generally known ejection distance.

By simultaneously grinding the side surface 12 in this manner, even if the workpiece is a plate 10 composed of a hard, brittle material such as a glass plate, a crack or the like formed in the side surface 12 as a result of scribing or the like can be efficiently removed simultaneously with the slight-chamfering process, thereby significantly improving the bending strength of the plate.

EXAMPLES

Processing examples of how a glass plate was chamfered by the method according to the present invention will be described below together with a comparative example.

Workpiece

In the examples and the comparative example, soda-lime glass plates (80 mm by 50 mm by 1.8 mm) scribed by a mechanical method were processed.

Common Processing Conditions

Figure 5:
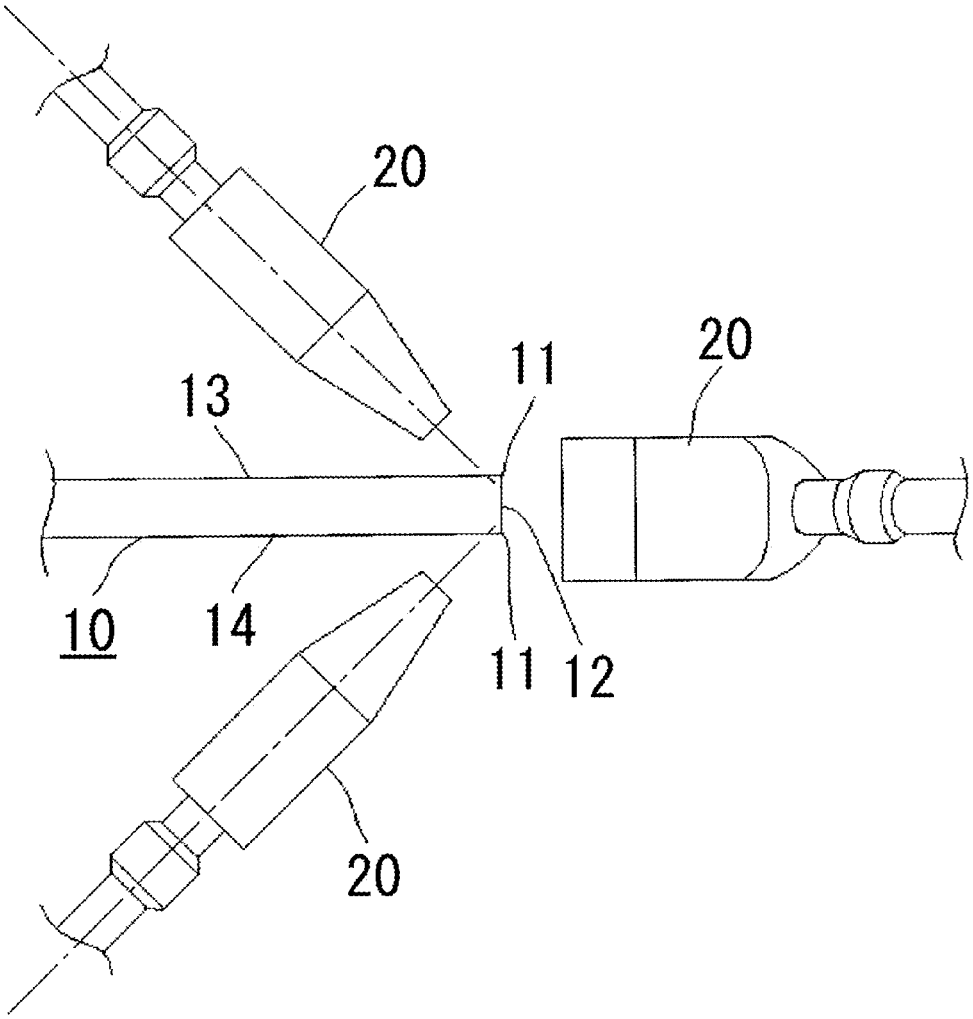
FIG. 5 illustrates a processing example in which the two edges and a side surface at the end of the plate are simultaneously processed by ejecting the abrasive thereto from three directions by using the method according to the present invention.

As shown in FIG. 5, an abrasive was simultaneously ejected from three sides to an end of the workpiece, thereby simultaneously performing slight-chamfering on edges thereof and a grinding process on a side surface of the glass plate. In this case, the distance between each edge of the glass plate and the tip of the corresponding slit nozzle was fixed at 3 mm for both examples. For examples in which this distance exceeded 3 mm, areas other than the edges were also processed, and the chamfering process itself could not be performed. Therefore, descriptions of such examples will be omitted.

Processing Conditions and Experimental Results

The processing conditions for the examples and the comparative example and experimental results of processed workpieces are shown in Table 1 below.

In Table 1 below, "deflective strength" indicates the deflective strength of each test piece as a percentage relative to the deflective strength of a reference piece defined as 100%. The reference piece used was formed by processing an end of the aforementioned glass plate by using a #1000-grit grindstone and then slight-chamfering each edge to C 0.2 mm.

The deflective strength was measured by using a universal testing device Model No. 5582 manufactured by Instron Co., Ltd. Specifically, the opposite ends of each test piece (glass plate) were supported at a fixed pitch of 60 mm, and the center of the test piece was pressed at 0.5 mm/min until the test piece broke. A load (N) corresponding to when the test piece broke was measured, and an average value for ten test pieces was obtained.

"d50 (μm)" under "Abrasive" is the so-called median diameter and indicates a grain diameter corresponding to when the cumulative grain size (number distribution) of the abrasive is at the 50% point.

TABLE 1

Processing Conditions and Experimental Results

| | | Comp. Example | Example 1 | Example 2 | Example 3 | Example 4 | Example 5 |
|---|---|---|---|---|---|---|---|
| Abrasive | Material. # | WA#320 | WA#1000 | WA#600 | WA#1000 | WA#1000 | WA#1500 |
| | d50 (μm) | 40 | 12 | 20 | 12 | 12 | 8 |
| Ejection Pressure (MPa) | | 0.2 | 0.2 | 0.2 | 0.1 | 0.2 | 0.5 |
| Slit Nozzle | W (mm) | 0.5 | 0.5 | 0.5 | 0.5 | 0.3 | 0.2 |
| | L (mm) | 15 | 15 | 15 | 15 | 15 | 20 |
| Ejection Angle | | 75 | 30 | 75 | 45 | 85 | 75 |
| Chamfered Amount (mm) | | C 0.2 | Unmeasurable | C 0.2 | C 0.2 | C 0.5 | C 0.4 |
| Chamfered Shape | | Poor | Fair | Good | Good | Good | Good |
| Deflective Strength (%) | | 63 | 105 | 95 | 105 | 100 | 110 |

Discussion of Experimental Results

Based on the above experimental results, in the comparative example in which a #320-grit abrasive which has a lower grit number (i.e., larger grain size) than #600 grit was used, even though the abrasive was ejected from a predetermined nozzle distance and with a predetermined ejected pressure according to the present invention, it was confirmed that the deflective strength was 63%, which was significantly lower than that of the reference piece.

Accordingly, in the test piece in the comparative example, cracks or micro-cracks were formed in the glass plate due to the use of an abrasive with a large grain size. It is conceivable that the deflective strength was reduced due to these cracks or micro-cracks acting as fracture starting points.

In contrast, in Examples 1 to 5, high deflective strength ranging between 95% and 110% was confirmed. With the use of an abrasive with a grit number higher than or equal to (i.e., a grain size smaller than or equal to) #600 grit, the occurrence of cracks and micro-cracks acting as fracture starting points can be suppressed, whereby the chamfering process can be conceivably performed without damaging the glass plates.

Furthermore, it was confirmed that the deflective strength was maintained or improved in the entire ejection pressure range of 0.1 MPa to 0.5 MPa.

Based on comparisons between Examples 1 to 5 in which the deflective strength was maintained or improved relative to the reference piece, in the Example 3 in which the ejection angle was 45°, a flat surface was formed as a result of the chamfering process. On the other hand, in the glass plate processed based on the method according to the Example 1 in which the ejection angle was reduced to 30°, the deflective strength was 105%, which was higher than that of the reference piece, due to removal of the edges along the periphery of the glass plate, but each chamfered surface was not completely flat, resulting in a curved cross-sectional shape, as shown in FIG. 7.

Accordingly, although the main purpose of chamfering, namely, removing sharp edges that may cause the occurrence of fractures, can be achieved by setting the ejection angle below 45°, it is preferable that the ejection angle be set to 45° or larger if a completely flat surface is to be formed by chamfering. It was confirmed that a highly-accurate flat surface was formed by chamfering even when the ejection angle was increased to 85°(Example 4).

Figure 8:
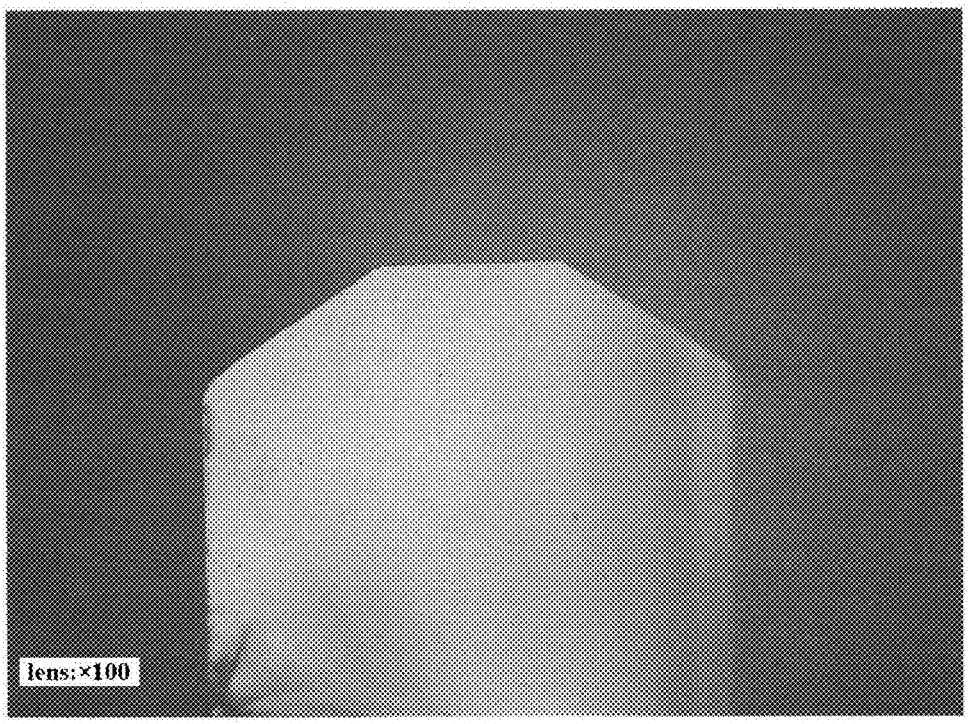
FIG. 8 is a photograph of an end of a glass plate (Example 5) processed based on the method according to the present invention.
Figure 9:
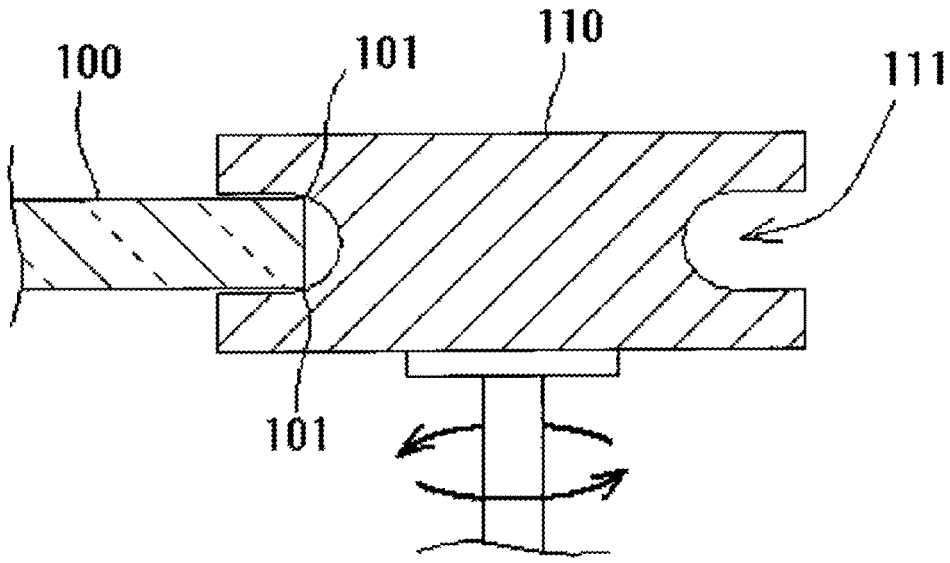
FIG. 9 Related Art
FIG. 9 illustrates a plate-end processing method in the related art (i.e., grinding using a grooved grindstone)
Figure 10:
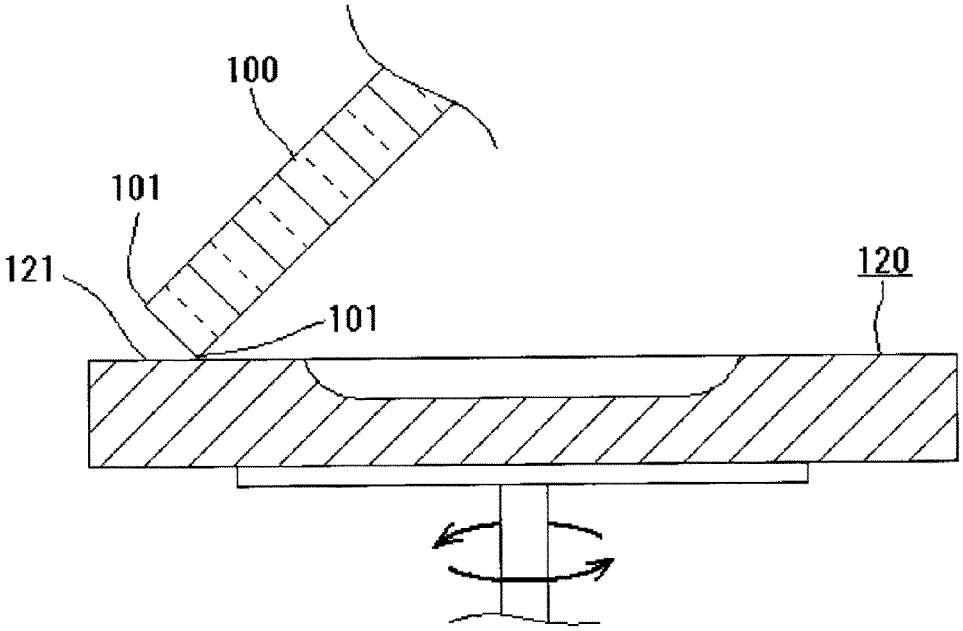
FIG. 10 Related Art
FIG. 10 illustrates a plate-end processing method in the related art (i.e., grinding with a flat surface of a rotating grinding wheel)
Figure 11:
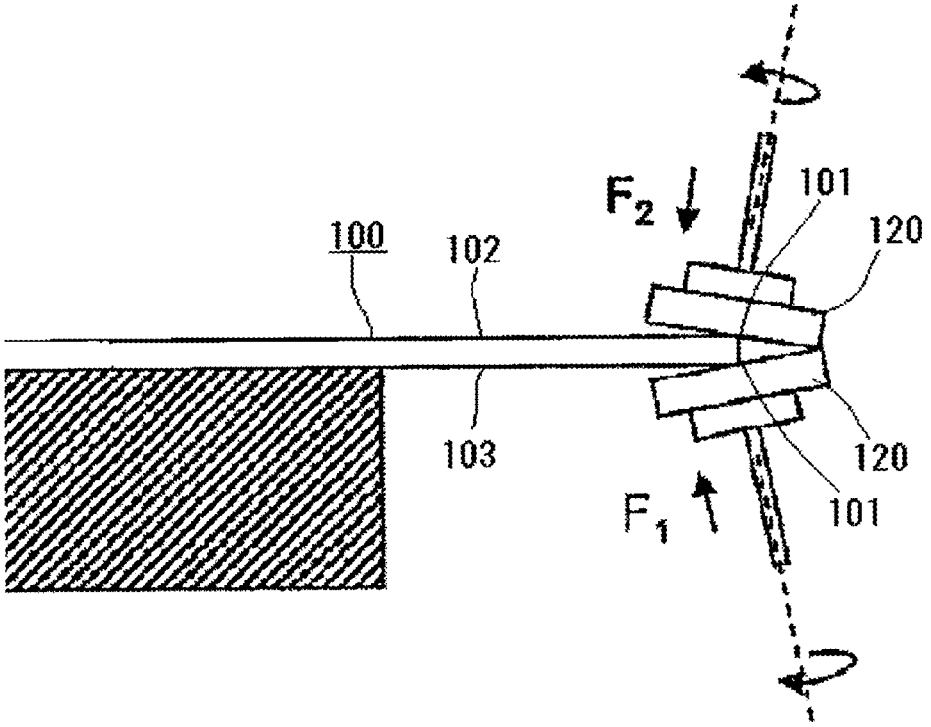
FIG. 11 Related Art
FIG. 11 illustrates a plate-end processing method in the related art (corresponding to FIG. 2A of Japanese Patent Laid-Open No. 2011-26195).

FIG. 8 is an enlarged photograph showing a cross section obtained by scribing a glass plate, in a widthwise direction, processed based on the method according to the Example 5.

It is apparent from FIG. 8 that, with the method according to the present invention, the chamfering process performed by blasting did not affect areas other than the cut areas, and the obtained chamfered surfaces were highly-accurate flat surfaces.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A plate-end processing method comprising:

disposing a slit nozzle having a slit-shaped opening at a nozzle tip such that an angle formed by a line extending an axis of the slit nozzle and a flat surface of a plate is between 45° and 85° and a longitudinal direction of the slit-shaped opening extends along a longitudinal direction of an edge to be processed, formed along an end of the plate, and such that a distance between the tip of the slit nozzle and an apex of the edge is smaller than or equal to 3 mm, and ejecting an abrasive with a median diameter smaller than or equal to 20 μm with an ejection pressure of 0.1 MPa to 0.5 MPa to the edge via the slit nozzle; and collecting the ejected abrasive and the abrasive and cut dusts adhered to the plate by suctioning the ejected abrasive, the adhered abrasive, and the adhered cut dusts by suction means at an average flow velocity of 30 m/s or higher from an inlet of the suction means, the inlet of the suction means being located on an extension of the axis of the slit nozzle so that a distance from the opening of the slit nozzle to an opening surface of the inlet of the suction means is set between 10 mm and 50 mm, and the opening surface of the inlet of the suction means is arranged so as to be opposite in parallel with an opening surface of the slit nozzle via the edge.

2. The plate-end processing method according to claim 1, wherein the nozzle tip of the slit nozzle is composed of diamond, corundum, boron carbide, cubic boron nitride, silicon carbide, cemented carbide, or zirconia.

3. The plate-end processing method according to claim 1, wherein the opening of the slit nozzle has a width ranging between 0.1 mm and 3 mm.

4. The plate-end processing method according to claim 1, further comprising ejecting the abrasive simultaneously to edges formed along opposite widthwise ends of a side surface at the end of the plate.

5. The plate-end processing method according to claim 4, further comprising ejecting an abrasive having a median diameter smaller than or equal to 20 μm or a grit number higher than or equal to #600 grit with an ejection pressure of 0.1 MPa to 0.5 MPa to the side surface at the end of the plate.

6. A blasting device for end-processing a plate, comprising:

abrasive ejecting means including a slit nozzle having a slit-shaped opening at a nozzle tip and ejecting an abrasive with a median diameter smaller than or equal to 20 μm together with compressed gas with an ejection pressure of 0.1 MPa to 0.5 MPa via the slit nozzle;

a work base on which the plate serving as a workpiece is disposed at a front side in an ejecting direction of the abrasive from the slit nozzle such that an angle formed by a line extending an axis of the slit nozzle and a flat surface of the plate is between 45° and 85°, and a longitudinal direction of the slit-shaped opening extends along a longitudinal direction of an edge to be processed, formed along an end of the plate, and such that a distance between the tip of the slit nozzle and an apex of the edge is smaller than or equal to 3 mm; and suction means for collecting the abrasive ejected from the slit nozzle and the abrasive and cut dusts adhered to the workpiece by suctioning the ejected abrasive, the adhered abrasive, and the adhered cut dusts at an average flow velocity of 30 m/s or higher from an inlet of the suction means, the inlet of the suction means being located on an extension of the axis of the slit nozzle so that a distance from the opening of the slit nozzle to an opening surface of the inlet of the suction means is set between 10 mm and 50 mm, and the opening surface of the inlet of the suction means is arranged so as to be opposite in parallel with an opening surface of the slit nozzle via the edge.

7. The blasting device according to claim 6, wherein the nozzle tip of the slit nozzle is composed of diamond, corundum, boron carbide, cubic boron nitride, silicon carbide, cemented carbide, or zirconia.

8. The blasting device according to claim 6, wherein the opening of the slit nozzle has a width ranging between 0.1 mm and 3 mm.

9. The blasting device according to claim 6, wherein the slit nozzle includes a plurality of slit nozzles that eject the abrasive simultaneously to edges formed along opposite widthwise ends of a side surface at the end of the plate.

10. The blasting device according to claim 9, further comprising a blast nozzle that ejects an abrasive having a median diameter smaller than or equal to 20 μm or a grit number higher than or equal to #600 grit with an ejection pressure of 0.1 MPa to 0.5 MPa to the side surface at the end of the plate.

* * * * *